US005849116A

United States Patent [19]

Miyasaka et al.

[11] Patent Number: 5,849,116

[45] Date of Patent: Dec. 15, 1998

[54] PRODUCTION METHOD FOR STEEL MATERIAL AND STEEL PIPE HAVING EXCELLENT CORROSION RESISTANCE AND WELDABILITY

[75] Inventors: Akihiro Miyasaka; Masaaki Obata; Takashi Motoyoshi, all of Tokai, Japan

[73] Assignee: Nippon Steel Corporation, Tokyo, Japan

[21] Appl. No.: 765,949

[22] PCT Filed: Jul. 18, 1995

[86] PCT No.: PCT/JP95/01428

§ 371 Date: Jan. 15, 1997

§ 102(e) Date: Jan. 15, 1997

[87] PCT Pub. No.: WO96/02678

PCT Pub. Date: Feb. 1, 1996

[30] Foreign Application Priority Data

Jul. 18, 1994 [JP] Japan ..... 6-186803

[51] Int. Cl.[6] ..... C21D 8/10; C21D 8/02

[52] U.S. Cl. ..... 148/592; 148/593; 148/609; 148/602; 219/61; 219/60.2

[58] Field of Search ..... 148/592, 593, 148/609, 602, 654; 219/612, 608, 61, 60.2

[56] References Cited

FOREIGN PATENT DOCUMENTS

| | | | |
|---|---|---|---|
| 47-16319 | 9/1972 | Japan . | |
| 57-85960 | 5/1982 | Japan . | |
| 60-86217 | 5/1985 | Japan | 148/654 |
| 62-56530 | 3/1987 | Japan | 148/609 |
| 63-134630 | 6/1988 | Japan . | |
| 63-219527 | 9/1988 | Japan | 148/609 |
| 63-238217 | 10/1988 | Japan . | |
| 2-88716 | 3/1990 | Japan . | |
| 3-20410 | 1/1991 | Japan . | |
| 4-99127 | 3/1992 | Japan . | |
| 4-99128 | 3/1992 | Japan . | |
| 4-191319 | 7/1992 | Japan . | |
| 4-191320 | 7/1992 | Japan . | |
| 5-255736 | 10/1993 | Japan . | |
| 5-263139 | 10/1993 | Japan . | |
| 6-100943 | 4/1994 | Japan . | |

OTHER PUBLICATIONS

J. of Corrosion, paper No. 211, 1984, by J. Klein NKK Engineering Report, 1989, No. 129, pp. 15–22.

*Primary Examiner*—Deborah Yee
*Attorney, Agent, or Firm*—Kenyon & Kenyon

[57] ABSTRACT

A steel material and a steel pipe each exhibiting an excellent corrosion resistance in an environment containing a wet carbon dioxide and a small amount of hydrogen sulfide are produced at low cost and with high productivity, a steel slab which contains, in wt %, 0.01 to 0.6% of Si, 0.02 to 1.8% of Mn, 7.5 to 14.0% of Cr, 1.5 to 4.0% of Cu and 0.005 to 0.1% of Al, which reduces C to not more than 0.02%, N to not more than 0.02%, P to not more than 0.025% and S to not more than 0.01%, and whose balance consists of Fe and unavoidable impurities, is heated to a temperature of 1,100° to 1,300° C., hot rolling is finished at a rolling finish temperature of not less than 800° C. and a cumulative rolling reduction quantity at a temperature not more than 1,050° C. is at least 65%, and cooling is carried out at a cooling rate of less than 0.02° C./sec to at least 500° C. so as to substantially convert the metallic structure to ferrite.

16 Claims, No Drawings

PRODUCTION METHOD FOR STEEL MATERIAL AND STEEL PIPE HAVING EXCELLENT CORROSION RESISTANCE AND WELDABILITY

TECHNICAL FIELD

This invention relates to a production method for a steel material and a steel pipe having excellent corrosion resistance and weldability. More particularly, this invention relates to a method for producing, easily and at a low cost, a steel material and a steel pipe having excellent corrosion resistance in an environment containing wet carbon dioxide and a small amount of wet hydrogen sulfide, and having also excellent weldability, for oil well pipes for the exploitation and production of petroleum/natural gases, line pipes used for the transportation, or vessels used for storage and various processings.

BACKGROUND ART

Petroleum and natural gases produced in recent years have become more and more of the type which contains wet carbon dioxide and hydrogen sulfide. It is well known that under such an environment, carbon steels and low alloy steels corrode remarkably. To transport such corrosive petroleum and natural gases, it has been customary in the past to add corrosion inhibitor as an anticorrosion countermeasure. In the case of offshore oil wells, however, it is enormously expensive to add and recover the corrosion inhibitor, and due to the problem of ocean pollution, the use of the corrosion inhibitor has become more and more difficult. For these reasons, a need for corrosion-resistant materials which do not need the addition of a corrosion inhibitor has become greater in recent years.

The introduction of stainless steels was first examined as corrosion-resistant materials for petroleum and natural gases containing large quantities of carbon dioxide. As described, for example, in L. J. Klein, "Corrosion", '84, Paper No. 211, a martensitic stainless steel containing about 0.2% of C and about 12 to 13% of Cr, as typified by AISI420 steel, has been widely used as steels which have high strength and are relatively economical. In order to acquire the high strength necessary for the oil well pipe by this steel, however, this steel involves the drawbacks that the steel cannot be tempered at a relatively high temperature and thus its impact toughness is low. Since the AISI420 steel contains about 0.2% of C, its weldability is very poor. In other words, it involves the problems that the hardness of a welding heat affected zone is very high, the pre-heating temperature and the post-heating temperature for preventing weld crack are very high, and the toughness of the welding heat affected zone is very poor.

API (American Petroleum Institute) standardizes AISI410 steel having a relatively lower C content as the line pipe, and "NKK Engineering Report", 1989, No. 129, pp. 15 to 22, reports an example where the AISI410 steel is produced as a UOE steel pipe. As this report describes, however, the AISI410 steel still has the problems that it cannot be converted to the austenite monophase at a high temperature, and because coarse delta-ferrite is formed during welding, the impact toughness of the weld portion is extremely low.

As described exemplarily in Japanese Unexamined Patent Publication (Kokai) Nos. 63-134630 and 63-238217, the martensitic stainless steel pipes typified by the AISI420 steel have been produced in the past as seamless steel pipes by a seamless steel pipe rolling method. However, the seamless steel pipes have the drawbacks that the production yield and productivity are extremely low, and the production cost is very high. One of the reasons why the cost of the seamless steel pipes is very high is because the steel pipes must be subjected to quenching-tempering heat-treatment after pipe making. Further, in the case of low C martensitic stainless steels which reduce as much as possible the C or C and N contents so as to improve the corrosion resistance or weldability, these steels cannot be produced easily by the seamless steel pipe rolling method.

Japanese Unexamined Patent Publication (Kokai) No. 4-191319 and No. 4-191320 disclose a method of producing a low carbon matertensitic stainless steel as a steel pipe, and Japanese Unexamined Patent Publication (Kokai) No. 4-99127 and No. 4-99128 disclose a method of producing a low C martensitic stainless steel pipe. On the other hand, Japanese Unexamined Patent Publication (Kokai) No. 5-263139 describes a method of producing an oil well steel pipe containing 12 to 14 wt % of Cr as an electric resistance seam welded steel pipe. Japanese Unexamined Patent Publication (Kokai) No. 6-100943 describes a method which produces a steel pipe from a martensitic stainless steel containing Ni, Cu, C, N and Mo in such quantities as to satisfy a predetermined condition, and then carries out the quenching-tempering treatment under a predetermined condition. However, these methods carry out heat-treatment such as normalizing-tempering after the steel pipe is produced, and are not free from the drawbacks in that the production cost is high and oxide scales are likely to form on the steel pipe surface. Further, in the case of the method described in Japanese Unexamined Patent Publication (Kokai) No. 6-100943, though C of the object steel is reduced, the steel contains 0.003 to 0.07% of N, and weldability is so low that the steel pipe cannot withstand practical application as a line pipe.

According to these methods which adjust the strength by the quenching-tempering treatment, the tempering temperature cannot be set to a relatively high temperature because the low C martensitic stainless steel contains large quantities of the alloy elements for improving hardenability, such as Ni, Mn and Cu. In consequence, though the steel pipe having a high strength can be produced relatively easily, steel pipes having a low strength cannot be produced easily. In the case of weld structures, there are many cases where a higher strength of the weld metal than that of the base metal, that is, a higher tensile strength or a higher yield strength than that of the base metal, is preferred, and the use of the martensitic stainless steel needs, in many cases, careful attention. This also holds true for the steels having a lower C content when the quenching-tempering heat-treatment is carried out. In addition, in an acidic environment which contains hydrogen sulfide, a lower strength is particularly preferred so as to prevent sulfide stress cracking, and for this purpose, a steel having a lower strength of the base metal and a steel pipe by such a steel have been strongly required. In contrast, the martensitic stainless steels produced by the conventional quenching-tempering method having a yield strength of the X-80 class or the L-80 class according to the API standard (both having specified minimum yield stress of at least 551N/mm$^2$) can be produced even when the steel has a low C content or low C+N content, or when the steel is a medium to high C steel. However, it has been very difficult to lower the yield strength to the X-65 class (specified minimum yield stress of at least 484N/mm$^2$).

Japanese Unexamined Patent Publication (Kokai) No. 5-255736 describes a production method of a martensitic stainless steel which imparts deformation of at least 65% to a steel having limited chemical compositions at a temperature range of not more than 1,100° C. However, the main object of this method is to soften a pipe or a bloom to an extent necessary for cutting the pipe or the bloom by a saw, but is not directed to obtain important characteristics such as the corrosion resistance and weldability as the final product such as the steel material or the steel pipe.

Japanese Patent Application Specification No. 4-291830 describes a production method of a martensitic stainless steel by applying working of at least 65% in terms of the total reduction quantity to a steel having limited contents at a temperature in the range of 750° C. to 1,100° C., cooling the steel at a cooling rate of not more than 0.1° C./sec, conducting again a normalizing treatment at an austenization temperature and conducting a tempering treatment immediately below an $A_{c1}$ point. According to this method, however, softening can be obtained to the extent sufficient for cutting an intermediate product by a saw, and it is difficult to obtain the necessary characteristics as the steel material or the steel pipe. Further, this method conducts the normalizing (corresponding metallurgically to quenching)-tempering heat-treatment for only the final product, and not only the production cost is high but it is difficult to sufficiently reduce the strength, in the same way as described above.

SUMMARY OF THE INVENTION

With the background described above, the present invention aims at providing a method of producing easily and at a low cost a steel material and a steel pipe having excellent corrosion resistance in a carbon dioxide containing environment or a hydrogen sulfide-containing acidic environment and also excellent in weldability.

The production method for a steel material having excellent corrosion resistance and weldability according to the present invention is as follows.

(1) A production method for a steel material having excellent corrosion resistance and weldability which comprises the steps of:

heating a steel slab containing, in terms of percent by weight:

Si: 0.01 to 0.6%,

Mn: 0.02 to 1.8%,

Cr: 7.5 to 14.0%,

Cu: 1.5 to 4.0%,

Al: 0.005 to 0.10%, and reducing,

C: to not more than 0.02%,

N: to not more than 0.02%,

P: to not more than 0.025%,

S: to not more than 0.01%, and the balance consisting of Fe and unavoidable impurities, to a temperature within the range of 1,100° to 1,300° C.;

finishing hot rolling having a cumulative rolling reduction quantity at a temperature not more than 1,050° C. of at least 65% and at a rolling finish temperature of not less than 800° C.;

carrying out cooling at a cooling rate of less than 0.02° C./sec to at least 500° C.; and obtaining a steel material the metallic structure of which substantially consists of ferrite.

(2) A production method for a steel material having excellent corrosion resistance and weldability according to the item (1), wherein the steel after the finish of hot rolling is cooled to a temperature below 500° C., and is reheated to a temperature of not less than 650° C. and satisfying the following condition:

$$T\times(\log t+21)\geqq 21{,}000$$

where:

T: reheating temperature (K), t: reheating holding time (min).

(3) A production method for a steel material having excellent corrosion resistance and weldability according to the item (1) or (2), wherein the slab further contains, as additional elements and in terms of percent by weight, at least one of the following elements:

Ni: not more than 1.5%,

Co: not more than 1.0%,

Mo: not more than 3.0%, and

W: not more than 3.0%, and wherein the sum of Ni+Co is not more than 1.5% and the sum of Mo+W is not more than 3.0%.

(4) A production method for a steel material having excellent corrosion resistance and weldability according to any of the items (1) through (3), wherein the slab further contains, as the additional elements, not more than 1.0% in total of at least one of the following elements:

Nb, V, Ti, Zr and Ta.

(5) A production method for a steel material having excellent corrosion resistance and weldability according to any of the item (1) through (4), wherein the C and N contents of the slab are reduced, in terms of percent by weight:

C: to not more than 0.015%, and

N: to not more than 0.015%, and the sum of C and N is not more than 0.02%.

(6) A production method for a steel material having excellent corrosion resistance and weldability according to any of the items (1) through (5), wherein the MC value of the slab chemical compositions given by the following formula is at least 0:

$$\text{MC value} = 80 + 420[\%C] + 440[\%N] + 30([\%Ni] + [\%Cu] + [\%Co] + 15[\%Mn] - 12([\%Si] + [\%Cr] + [\%Mo]) - 24[\%Nb] - 48([\%V]) + [\%Ti] + [\%Al]) - 6[\%W]$$

where [%X] represents the content of an element X expressed by percent by weight.

A production method of a steel pipe having excellent corrosion resistance and weldability according to the present invention is as follows.

(7) A production method for a steel pipe having excellent corrosion resistance and weldability, which comprises serially making a steel pipe through the following steps ① and ② from a slab which contains, in terms of percent by weight, the following elements:

Si: 0.01 to 0.6%,

Mn: 0.02 to 1.8%,

Cr: 7.5 to 14.0%,

Cu: 1.5 to 4.0%, and

Al: 0.005 to 0.10%, which reduces the following elements:

C: to not more than 0.02%,

N: to not more than 0.02%,

P: to not more than 0.025%, and

S: to not more than 0.01%, and the balance of which consists of Fe and unavoidable impurities:

① heating the slab to a temperature within the range of 1,100° to 1,300° C., finishing hot rolling within a temperature range where the metallic structure substantially comprises an austenite monophase, and also finishing hot rolling where a cumulative rolling reduction quantity at a temperature not more than 1,050° C. is at least 65%, to thereby form a hot coil having a strip thickness of 3.0 to 25.4 mm, coiling the hot coil within a temperature range where the metallic structure substantially comprises the austenite monophase, and carrying out cooling at a cooling rate of less than 0.02° C./sec to at least 500° C., and forming a steel strip the metallic structure of which substantially comprises ferrite; and ② slitting the hot coil into a predetermined width, continuously shaping it into a cylindrical shape and welding both ends of the steel strip by electric resistance welding to thereby form an electric resistance seam welded steel pipe.

(8) A production method for a steel pipe having excellent corrosion resistance and weldability according to the item (7), wherein the hot coil is cooled to not more than 500° C. and is then reheated at a temperature not less than 650° C. and satisfying the following condition:

$$T\times(\log t+21)\geqq 21{,}000$$

where T is a reheating temperature (K) and t is a reheating holding time (min).

(9) A production method for a steel pipe having excellent corrosion resistance and weldability according to the item (7) or (8), wherein the slab further contains, as additional elements and in terms of percent by weight, at least one of the following elements:

Ni: not more than 1.5%,

Co: not more than 1.0%,

Mo: not more than 3.0%, and

W: not more than 3.0%, and wherein the sum of Ni+Co is not more than 1.5% and the sum of Mo+W is not more than 3.0%.

(10) A production method for a steel pipe having excellent corrosion resistance and weldability according to any of the item (7) through (9), wherein the slab further contains, as additional elements and in terms of percent by weight, not more than 1.0% in total of at least one of Nb, V, Ti, Zr and Ta.

(11) A production method for a steel pipe having excellent corrosion resistance and weldability according to any of the item (7) through (10), wherein the C and N contents of the slab is reduced, in terms of percent by weight:

C: not more than 0.015%, and

N: not more than 0.015%, and the sum of C and N is reduced to not more than 0.02%.

(12) A production method for a steel pipe having excellent corrosion resistance and weldability according to any of the items (7) through (11), wherein the MC value of the slab chemical compositions given by the following formula is at least 0:

$$\text{MC value} = 80 + 420[\%C] + 440[\%N] + 30([\%Ni] + [\%Cu] + [\%Co] + 15[\%Mn] - 12([\%Si] + [\%Cr] + [\%Mo]) - 24[\%Nb] - 48([\%V]) + [\%Ti] + [\%Al]) - 6[\%W]$$

where [%X] represents the content of an element X expressed by percent by weight.

(13) A production method for a steel pipe having excellent corrosion resistance and weldability according to any of the items (7) to (12), wherein pipe making is conducted by electric resistance seam welding, and after the temperature of the electric resistance seam welded portion drops to a temperature not more than an Ms point, at least the electric resistance seam welded portion and portions within 2 mm from both sides of the seam welded portion are reheated to a temperature of 650° C. to an $A_{c1}$ transformation point, and are then cooled.

(14) A production method for a steel pipe having excellent corrosion resistance and weldability according to any of the items (7) to (12), wherein pipe making is conducted by electric resistance seam welding, at least the electric resistance seam welded portion and portions within 2 mm from both sides of the seam welded portion are reheated to a temperature not less than (an $A_{c3}$ transformation point +50° C.), are then rapidly cooled to a temperature not more than an Ms point, and furthermore, at least the electric resistance seam welded portion and the portions within 2 mm from both sides of the seam welded portion are reheated to a temperature of 650° C. to an $A_{c1}$ transformation point, and are then cooled.

(15) A production method for a steel pipe having excellent corrosion resistance and weldability according to the item (13) or (14), wherein, when at least the electric resistance seam welded portion and the portions within 2 mm from both sides of the seam welded portion are reheated to 650° C. to the $A_{c1}$ transformation point and are then cooled, the full-body of steel pipe is reheated.

(16) A production method for a steel pipe having excellent corrosion resistance and weldability according to the item (13) or (14), wherein, when at least the electric resistance seam welded portion and the portions within 2 mm from both sides of the seam welded portion are reheated to 650° C. to the $A_{c1}$ transformation point and are then cooled, only the portion in the vicinity of the electric resistance seam welded portion is reheated by a post-annealer.

THE BEST MODE FOR CARRYING OUT THE INVENTION

In the case of the stainless steel of the AISI420 steel that has been examined in the past as the corrosion-resistant material for petroleum/natural gases containing large quantities of carbon dioxide, the tempering temperature cannot be much raised during the quenching-tempering treatment. Though steel pipes having a high strength can be produced relatively easily, this method has not been suitable for the production of steel pipes having a low strength. In the case of the weld structures, a weld metal having a higher strength than that of the base metal is preferred and from this point, too, steel materials and steel pipes having lower strength of the base metal have been required. The present invention solves this problem, makes it possible to produce at a low cost a steel material and a steel pipe having a yield strength of about 500 to about 560N/mm$^2$, restricts the rise of the hardness of the welding heat affected zone, and further improves corrosion resistance or weldability.

The production methods of the steel material and the steel pipe according to the present invention limit the ranges of the chemical compositions of the steel from the aspect of the corrosion resistance and weldability, and optimize the hot rolling condition as well as the cooling condition after rolling as the production condition for accomplishing the structure consisting principally of ferrite.

Hereinafter, the reasons for limitation of the production condition of the steel pipe having excellent corrosion resistance or weldability according to the present invention will be described. First, the reason for limitation of each element as the chemical component will be explained. The term "%" represents "wt %" unless it is specifically stipulated otherwise.

Si:

It is effective to add Si as a deoxidizing agent and as a strengthening element to a steel containing 7.5 to 14.0% of Cr. However, if its content is less than 0.01%, the deoxidizing effect is not sufficient, and even when its content exceeds 0.6%, the effect not only gets into saturation but the impact toughness and electric resistance seam weldability drop adversely. Therefore, the Si content is limited to 0.01 to 0.6%. When the required strength can be secured by the combination with the contents of other alloy elements or with the production condition, a large amount of Si need not be added, and the Si addition amount is preferably reduced to not more than 0.2% as the amount necessary and sufficient for deoxidation.

Mn:

Mn is necessary as a deoxidizing agent for a steel containing 7.5 to 14.0% of Cr, and at least 0.02% must be added. Mn is also a useful element for stabilizing the austenite structure at a high temperature. If its content exceeds 1.8%, however, the effect gets into saturation, and the excessive Mn content will invite difficulties in steel making. Therefore, the upper limit of the Mn content is set to 1.8%.

Cr:

At least 7.5% of Cr must be contained in order to secure the corrosion resistance as one of the objects of the present invention. If its content exceeds 14.0%, however, not only the production cost becomes unnecessarily higher, but the impact toughness drops, too. Therefore, the Cr content is set to 7.5 to 14.0%.

Cu:

Cu is an essential and useful element in order to convert the metallic structure to the structure consisting mainly of austenite at high temperature when it is added to a high Cr content steel in which C and N contents are reduced. If the Cu content is less than 1.5%, austenite is not stable at a high temperature and ferrite is likely to be formed. If the ferrite has already been formed and mixed in austenite during hot working, hot workability drops and at the same time, the impact toughness after cooling drops remarkably. In order to convert the metallic structure at a high temperature to the austenite monophase, at least 1.5% of Cu must be added. On the other hand, if Cu is added in an amount exceeding 4.0%, ferrite transformation becomes difficult even when cooling is carried out by controlling the cooling rate after hot working. Therefore, the upper limit of the Cu content is set to 4.0%.

Al:

At least 0.005% of Al must be added as the deoxidizing agent. When Al is added in an amount exceeding 0.10%, however, coarse oxide type inclusions are formed and the stress corrosion cracking resistance deteriorates. Therefore, the upper limit of the Al content is set to 0.10%.

C:

C forms carbides with Cr, lowers the toughness and the corrosion resistance, remarkably increases the hardness of the welding heat affected zone and lowers weldability. Therefore, the C content is limited to not more than 0.02%.

N:

N lowers the toughness of the weld portion, remarkably increases the hardness of the welding heat affected zone and lowers weldability. Therefore, the N content is set to not more than 0.02%.

When it is very necessary to particularly reduce the hardness of the welding heat affected zone and to improve weldability in line pipes or weld structures such as pressure vessels, it is preferred to limit the C content to not more than 0.015% and the N content to not more than 0.015%, and to set the sum of the C and N contents to not more than 0.02%.

P:

A large amount of P content will lower the toughness. Therefore, the P content must be limited to not more than 0.025%, and the P content is preferably as low as possible.

S:

Since a large amount of S content, too, lowers hot workability, ductility and corrosion resistance, the S content is preferably low, and must be limited to not more than 0.01%.

The elements described above are the fundamental elements of the steel as the object of the present invention, but the following elements may be added, whenever necessary, so as to further improve the steel characteristics.

Ni and Co:

When added to a steel containing 7.5 to 14.0% of Cr, Ni and Co provide a remarkable effect in improving the corrosion resistance and the impact toughness. However, the amount of Ni alone or the sum of Ni+Co exceeds 1.5%, it becomes difficult to form the structure consisting substantially of ferrite and to lower the strength however the hot rolling condition or the condition after hot rolling may be controlled. Therefore, the upper limit of the Ni content and the upper limit of Ni+Co are set to 1.5%. When Co is added in the amount exceeding 1.0%, the effect of addition gets into saturation whereas the cost increases. Therefore, the Co content is set to not more than 1.0% both when it is added alone and when it is added complexly with Ni, i.e., Ni+Co.

Mo and W:

Mo and W have the effect of improving the corrosion resistance in the wet carbon dioxide environment when they are added to a steel containing 7.5 to 14.0% of Cr. When the content of each of these elements or their sum exceeds 3.0%, the effect gets into saturation whereas alloy elements such as Ni, Co, etc., must be added in greater amounts than the upper limits described above so as to secure hot workability and stability of the austenite structure at a high temperature. Then, the strength of the steel cannot be lowered easily by controlling the hot-rolling condition and the cooling condition after hot-rolling. Therefore, the upper limit of the Mo and W is set to 3.0% and the sum of the Mo+W content is also set to not more than 3.0%.

Nb, V, Ti, Zr and Ta:

When Nb, V, Ti, Zr and Ta are added to a steel containing 7.5 to 14.0% of Cr, these elements provide a large effect of reducing the hardness of the welding heat affected zone and improving the corrosion resistance. When they are added in excessive amounts, however, the effect get into saturation whereas the toughness of the base metal drops. Therefore, the upper limit of each of Nb, V, Ti, Zr and Ta or the sum of at least two of these elements is set to not more than 1.0%. When a particularly excellent toughness of the base metal is required, it is preferred that the content of each of these elements or the sum of at least two of them does not exceed 0.5%. On the other hand, to sufficiently lower the hardness of the welding heat affected zone, the sum of the contents of at least one of Nb, V, Ti, Zr and Ta is preferably at least 0.1%.

It is further preferred that the MC value which is defined by the following formula is at least 0 as the combination of the contents of these elements:

$$\text{MC value} = 80 + 420[\%C] + 440[\%N] + 30([\%Ni] + [\%Cu] + [\%Co] + 15[\%Mn] - 12([\%Si] + [\%Cr] + [\%Mo]) - 24[\%Nb] - 48([\%V]) + [\%Ti] + [\%Al]) - 6[\%W]$$

where [%X] is the content of an element X expressed by wt %.

When the MC value is less than 0, there is the possibility that delta-ferrite is formed at a high temperature. When large quantities of delta-ferrite exist in the hot rolling zone, the impact toughness and the strength of the steel plate or the steel pipe drop. When the MC value is set to at least 0 so as to avoid this problem, delta-ferrite is not formed at the high temperature and a structure substantially consisting of austenite is obtained. When this structure is allowed to undergo ferrite transformation during the cooling process, a steel plate and a steel pipe having excellent toughness and a suitable strength can be obtained.

In addition to the components described above, the steel of the present invention may contain B, Hf, etc., as impurities mixed from the scraps or the components added so as to regulate the toughness and workability. Alternatively, further, rare earth metal elements (REM), Ca, Mg, etc., may be added to as to improve hot workability and the impact toughness, and the addition of these elements does not fall off from the scope of the present invention. The term "rare earth metal elements" represent the elements having the atomic numbers of 57 to 71, 89 to 103 and Y. In the present invention, the oxygen content is not particularly limited. However, the oxygen content is preferably as small as possible because oxygen is the impurity that is the source for the formation of oxide type non-metallic inclusions, and the oxygen content is more preferably limited to not more than 0.004%.

Next, the process of the present invention and the reason for its limitation will be explained.

Slab heating temperature:

The slab must be heated uniformly to its center portion so as to secure hot workability during hot rolling. When heating is carried out at a temperature higher than 1,300° C., however, the material loss due to the formation of the oxide scale becomes so great that the production yield drops. When the heating temperature is less than 1,100° C., on the other hand, the deformation resistance in hot rolling becomes excessively great. For these reasons, the slab heating temperature is limited to 1,100° C. to 1,300° C.

Hot rolling:

Ordinary thick plate rolling or hot strip rolling can be employed for hot rolling. In the case of the hot coil, the strip thickness is set to 3.0 to 25.4 mm from the aspect of practical utility as the oil well pipe or the line pipe. From the aspect of productivity in subsequent electric resistance seam welding, the shape of the steel for the electric resistance seam welded steel pipe is the hot coil.

Rolling condition:

To obtain a steel material having a metallic structure substantially consisting of ferrite during the cooling process after hot rolling, it is necessary that hot rolling be finished within a temperature range in which the metallic structure substantially comprises the austenite monophase, and the cumulative rolling reduction quantity at a temperature not more than 1,050° C. be at least 65%. This is because reduction at temperature higher than 1,050° C. does not provide the effect of promoting the ferrite transformation during the cooling process. In order to allow the steel whose hot rolling is finished in the austenite zone to sufficiently undergo the ferrite transformation, the cumulative rolling reduction quantity at a temperature not more than 1,050° C. must be at least 65%. When the cumulative rolling reduction quantity at a temperature not more than 1,050° C. is less than 65%, austenite does not sufficiently undergo ferrite transformation, and a part, or the whole, of austenite is converted to martensite. In this case, in addition to the drop of the toughness, it becomes difficult to lower the strength to a suitable level. If the hot rolling temperature is too low, on the other hand, the ferrite transformations starts during hot rolling, therefore the ferrite phase is hot rolled and lowers the toughness, or the strip temperature becomes lower than the temperature at which the ferrite transformation can take place. For these reasons, the ferrite transformation does not effectively proceed. Therefore, hot rolling must be finished at a temperature not less than 800° C. Further, to more stably obtain the ferrite structure after hot rolling, the cumulative rolling reduction quantity is preferably at least 75% at not more than 1,050° C., or the cumulative rolling reduction quantity at a temperature not more than 1,000° C. is preferably at least 65%.

Cooling condition:

When the steel material after the finish of hot rolling or the hot coil coiled after the finish of hot rolling is cooled, it must be cooled at a cooling rate of less than 0.02° C./sec to at least 500° C. This is to sufficiently convert the austenite subjected to hot rolling to ferrite. When the cooling rate is not less than 0.02° C./sec, ferrite transformation does not sufficiently proceed even when the austenite is processed at a temperature not more than 1,050° C. and hence, a part or the whole of the austenite undergoes martensite transformation during the cooling process. In consequence, the structure becomes non-uniform and the impact toughness drops. In addition, the strength cannot be lowered to a suitable strength level for use as the line pipe or the pressure vessel. In the steel to which the method of the present invention is directed, on the other hand, ferrite transformation from the austenite has completed at 500° C. Therefore, any cooling rate may be employed at a temperature less than 500° C.

When the steel plate is slowly cooled, each plate may be slowly cooled while holding the temperature, but it is effective to conduct slow cooling by stacking two or more steel plates one upon another, putting then a slow cooling cover and then carrying out slow cooling. In the case of the hot coil, too, slow cooling may be carried out by placing a slow cooling cover to each hot coil, but it is effective to stack a plurality of hot coils one upon another or to align them in a transverse direction, and to use one heat-holding cover for slowly cooling them.

Reheating:

To further lower the strength of ferrite transformed from hot rolled austenite and to further improve the impact toughness, reheating is effective. Reheating of the steel material or the hot coil must be carried out after it is once cooled to a temperature not more than 500° C. after hot rolling, and thus causing ferrite transformation sufficiently. Reheating effects will be insufficient if reheating is carried out before cooling to a temperature of not more than 500° C. Once the temperature of the steel material or the hot coil drops below 500° C., reheating may be carried out before the steel material or the hot coil is cooled down to room temperature, or after each is cooled to room temperature and is then reheated to a temperature of not less than 650° C. to the $A_{c1}$ transformation point.

The object of reheating is to keep Cu in an overaging range by reheating to a high temperature, to precipitate Cu and to lower the strength. Therefore, when reheating is carried out, averaging must be effected within a range in which Cu does not contribute to the strength and for this purpose, a temperature of not lower than 650° C. is necessary. If the reheating temperature is less than 650° C., the drop of the strength is not sufficient, and particularly when the reheating temperature is less than 600° C., Cu is finely precipitated and raises the strength, on the contrary, and is likely to lower the impact toughness.

Further, if the reheating temperature T(K) and the holding time (t) are set as the reheating condition so as to satisfy the relation $T\times(\log t+21)\geqq 21{,}000$ at the time of reheating, the strength of ferrite transformed from the hot rolled austenite can be sufficiently lowered and the impact toughness can be further improved.

The reheating atmosphere may be an air atmosphere, but in order to reduce the oxide scale on the steel surface and to improve the production yield of the steel pipe without lowering the corrosion resistance, the reheating atmosphere is more preferably a slightly oxidizing atmosphere, a non-oxidizing atmosphere or a reducing atmosphere. For example, it is effective to use a mixed gas which contains 5 to 15% of hydrogen and the balance of nitrogen or argon gas.

Reheating of the steel material is effective for causing averaging and precipitation of Cu and for adjusting the strength of the steel to a suitable level. Not only reheating of the steel sheet after hot rolling but reheating at an intermediate stage after the hot rolled steel sheet is formed into a pressure vessel and various structures and reheating at the product stage can be used. When the hot coil is produced into the electric resistance seam welded steel pipe, reheating may be carried out at the hot coil stage or the full-body of the steel pipe may be reheated after the hot coil is formed into the electric resistance seam welded pipe. In short, it is effective to carry out reheating at a temperature of not less than 650° C. and under the condition satisfying the condition $T\times(\log t+21)\geqq 21{,}000$ at any of the stages after the slab is hot rolled and is then cooled under predetermined conditions and before the final product is used. The reheating stage can be selected suitably in accordance with the shape and the size of the product, its application and other secondary working.

Forming of hot coil and electric resistance seam welding:

Ordinary electric resistance seam welded steel pipe production steps can be employed for forming and electric resistance seam welding of the hot coil. After the steel strip is slitted into a predetermined width in accordance with the outer diameter necessary for the oil well pipe or the line pipe, and both ends of the steel pipe are welded by electric resistance welding while it is being continuously shaped into a cylindrical shape, so as to produce an electric resistance seam welded steel pipe.

In the present invention, the steps of producing a steel pipe by electric resistance seam welding, reheating at least the electric resistance seam portion and portions within a 2 mm from both sides of the seam welded portion to a temperature of not less than 650° C. to the $A_{c1}$ transformation point after the temperature of the electric resistance seam portion drops below the Ms point, and thereafter cooling them, may be added, whenever necessary, in addition to the steps described above. The object of these additional steps is to lower the hardness of the hardened structure occurring locally at the time of electric resistance seam welding and also to improve the toughness of the electric resistance seam welded portion. Since the steel as the object of the method of the present invention has high hardenability, the electric resistance seam welded portion undergoes martensite transformation at an ordinary cooling rate, but such reheating does not provide any effect unless it is carried out after the temperature of the electric resistance seam welded portion drops below the Ms point. To sufficiently lower the hardness of the hardened structure that is locally formed, the reheating temperature must be not less than 650° C. When the reheating temperature exceeds the $A_{c1}$ transformation point, however, fresh martensite is formed during subsequent cooling, and the toughness of the base metal and the stress corrosion cracking resistance drop.

When reheating of the electric resistance seam welded portion is carried out, only the portions in the proximity of the electric resistance seam welded portion may be reheated immediately after electric resistance seam welding by using a post-annealer, for example, or the full-body of the steel pipe may be heated. What is important is that the electric resistance seam welded portion and the portions within 2 mm from both sides of the seam welded portion are reheated.

In the present invention, the steps of reheating at least the electric resistance seam welded portion and the portions within 2 mm from both sides of the seam welded portion to a temperature not less than ($A_{c3}$ transformation point+50° C.), rapidly cooling them to a temperature not more than an Ms point, reheating again at least the electric resistance seam portion and the portions within 2 mm from both sides of the seam welded portion to a temperature of not less than 650° C. to the $A_{c1}$ transformation point, and thereafter cooling them, may be added in addition to the steps described above, whenever necessary. The object of this step is to reduce non-uniformity of the metallic structure occurring at the time of electric resistance seam welding and thus to improve the toughness of the electric resistance seam welded portion. When at least the electric resistance seam portion and the portions within 2 mm from both sides of the seam welded portion are reheated to a temperature not less than ($A_{c3}$ transformation point+50° C.), only the portions in the proximity of the electric resistance seam welded portion is preferably reheated immediately after electric resistance seam welding by using the post-annealer. When the full-body of the steel pipe is heated, the entire steel pipe is hardened, so that the material properties secured at the stage of the hot coil are lost. After reheating to the temperature not less than ($A_{c3}$ transformation point +50° C.), the steel pipe must be rapidly cooled to a temperature not more than the Ms point. This is because, when reheating is performed to a temperature of not less than 650° C. to the $A_{c1}$ transformation point before the temperature drops below the Ms point, the reheating effect does not appear. Particularly when continuous in-line processing is carried out by using the post-annealer, rapidly cooling is essentially necessary. On the other hand, when at least the electric resistance seam welded portion and the portions within 2 mm from both sides of the seam welded portion are reheated to the temperature of not less than 650° C. to the $A_{c1}$ transformation point, only the portions in the proximity of the electric resistance seam welded portion may be reheated immediately after electric resistance seam welding by using the post-annealer, for example, or the full-body of the steel pipe may be heated.

The steel material produced by the method of the present invention may be used as the steel plate or may be worked and used as the structural member. It is further possible to form the steel plate as a UOE steel pipe and to use it for piping arrangement, or to shape and weld the steel sheet by the bending roll method into a thick steel pipe having a large diameter. When the hot coil is produced according to the method of the present invention, the hot coil can be used for not only the electric resistance seam welded steel pipe but also a spiral steel pipe.

EXAMPLES

Hereinafter, Examples of the Present invention will be explained.

EXAMPLE 1

Steels having the chemical compositions tabulated in Table 1 were melted, and slabs having thickness of 240 mm were produced. Next, ordinary hot rolling was carried out under the condition tabulated in Table 2 to produce steel plates having a thickness of 20 mm. The slab heating temperature before hot rolling was 1,230° C. Comparative Example 15 corresponded to an AISI420 steel. A tensile specimen was sampled from each steel plate, and a tensile test was carried out so as to measure a yield strength.

Next, these steel plates were welded by manual arc welding to form weld joints. The welding heat input was 17 kJ/cm. JIS No. 4 impact specimen (full size) were sampled from the base metal and from the heat affected zone of the weld portion to conduct an impact test. The maximum hardness of the welding heat affected zone was measured by a Vickers hardness at a load of 1 kg. On the other hand, a testpiece was sampled from the base metal of each steel plate, and a corrosion test under a wet carbon dioxide environment was carried out. Testpieces each having a thickness of 3 mm, a width of 15 mm and a length of 50 mm were used for the corrosion test in the wet carbon dioxide environment at a testing temperature of 120° C. inside an autoclave or at 150° C. by immersing each testpiece in a 5% NaCl aqueous solution for 30 days at a carbon dioxide pressure of 40 atms. The corrosion rate was calculated from

TABLE 1

| | | Chemical Components (wt %) | | | | | | | | | | | | | |
|---|---|---|---|---|---|---|---|---|---|---|---|---|---|---|---|
| | | C | Si | Mn | P | S | Cr | Cu | Al | N | Ni | Co | Mo | W | others |
| Example of this Invention | 1 | 0.008 | 0.14 | 0.38 | 0.013 | 0.002 | 12.39 | 2.48 | 0.02 | 0.006 | — | — | — | — | |
| | 2 | 0.006 | 0.13 | 0.44 | 0.018 | 0.003 | 12.53 | 3.16 | 0.04 | 0.008 | — | — | — | — | |
| | 3 | 0.008 | 0.11 | 0.30 | 0.018 | 0.002 | 12.48 | 3.04 | 0.04 | 0.010 | — | — | — | — | |
| | 4 | 0.010 | 0.12 | 0.51 | 0.022 | 0.002 | 13.33 | 2.10 | 0.10 | 0.007 | 0.55 | — | — | — | |
| | 5 | 0.012 | 0.22 | 0.29 | 0.008 | 0.003 | 11.63 | 3.06 | 0.05 | 0.005 | 0.49 | — | 1.21 | — | |
| | 6 | 0.008 | 0.30 | 0.31 | 0.009 | 0.003 | 11.60 | 3.12 | 0.04 | 0.010 | — | 0.26 | — | — | |
| | 7 | 0.010 | 0.33 | 0.47 | 0.017 | 0.004 | 12.59 | 3.67 | 0.03 | 0.005 | — | — | 0.98 | — | |
| | 8 | 0.004 | 0.28 | 0.42 | 0.016 | 0.003 | 12.99 | 2.11 | 0.04 | 0.005 | 0.94 | — | — | 1.44 | Ti 0.25 |
| | 9 | 0.007 | 0.22 | 0.11 | 0.020 | 0.002 | 11.96 | 3.32 | 0.06 | 0.008 | — | — | — | — | Ti 0.18, Nb 0.15 |
| | 10 | 0.007 | 0.20 | 0.38 | 0.011 | 0.001 | 9.06 | 2.85 | 0.05 | 0.008 | — | — | 0.88 | 0.56 | V 0.55 |
| | 11 | 0.008 | 0.22 | 1.66 | 0.019 | 0.002 | 13.04 | 1.85 | 0.05 | 0.008 | — | 0.30 | — | — | Ti 0.20, Zr 0.10 |
| | 12 | 0.010 | 0.19 | 0.51 | 0.011 | 0.001 | 12.41 | 2.89 | 0.05 | 0.007 | 1.03 | — | 0.53 | — | Nb 0.22, Ti 0.17 |
| Comparative Example | 13 | 0.066 | 0.27 | 0.46 | 0.014 | 0.004 | 12.66 | 3.05 | 0.07 | 0.038 | 0.83 | — | — | — | Ti 0.12 |
| | 14 | 0.015 | 0.30 | 0.55 | 0.014 | 0.005 | 12.73 | — | 0.06 | 0.017 | — | — | — | — | |
| | 15 | 0.190 | 0.44 | 0.25 | 0.011 | 0.003 | 13.09 | — | 0.11 | 0.016 | 0.27 | — | — | | |
| | 16 | 0.017 | 0.22 | 0.73 | 0.018 | 0.003 | 12.87 | 2.53 | 0.04 | 0.006 | — | — | 0.29 | — | |
| | 17 | 0.015 | 0.30 | 0.56 | 0.017 | 0.002 | 12.95 | 3.04 | 0.05 | 0.008 | 3.61 | — | — | — | Ti 0.23 |

TABLE 2

| | | Rolling Finish Temp. (°C.) | Cumulative Rolling Reduction Ratio Below 1,050° C. (%) | Cooling Rate Down to 500° C. (°C./sec) | Reheating Treatment Condition (°C. × h) | Yield Strength (N/mm²) | Corrosion Resistance 120° C. | Corrosion Resistance 150° C. | Max. Hardness of Welding Heat Affected Zone | Impact Toughness Base Metal | Impact Toughness Welding Heat Affected Zone |
|---|---|---|---|---|---|---|---|---|---|---|---|
| Example of this Invention | 1 | 840 | 74 | 0.015 | nil | 557 | ◎ | ◎ | ○ | ○ | ○ |
| | 2 | 830 | 85 | 0.01 | 720 × 2 | 525 | ◎ | ◎ | ○ | ○ | ○ |
| | 3 | 840 | 90 | 0.01 | nil | 533 | ◎ | ◎ | ○ | ○ | ○ |
| | 4 | 840 | 75 | 0.01 | 730 × 1 | 527 | ◎ | ◎ | ○ | ○ | ○ |
| | 5 | 840 | 85 | 0.01 | 710 × 1.5 | 528 | ◎ | ◎ | ○ | ○ | ○ |
| | 6 | 850 | 80 | 0.01 | 680 × 4 | 541 | ◎ | ◎ | ○ | ○ | ○ |
| | 7 | 850 | 80 | 0.01 | 730 × 0.5 | 528 | ◎ | ◎ | ○ | ○ | ○ |
| | 8 | 900 | 85 | 0.01 | nil | 550 | ◎ | ◎ | ○ | ○ | ○ |
| | 9 | 920 | 75 | 0.01 | 700 × 2 | 527 | ◎ | ◎ | ○ | ○ | ○ |
| | 10 | 850 | 80 | 0.005 | 720 × 2 | 524 | ◎ | ○ | ○ | ○ | ○ |
| | 11 | 850 | 80 | 0.01 | 750 × 1 | 520 | ◎ | ◎ | ○ | ○ | ○ |
| | 12 | 850 | 85 | 0.01 | 720 × 3 | 528 | ◎ | ◎ | ○ | ○ | ○ |
| Comparative Example | 13 | 850 | 70 | 0.5 | nil | 1154 | x | xx | xx | xx | xx |
| | 14 | 880 | 70 | 0.005 | " | 296 | ○ | x | ○ | x | xx |
| | 15 | 880 | 70 | 0.02 | " | 755 | xx | xx | weld cracking | xx | weld cracking |
| | 16 | 880 | 75 | 0.5 | " | 912 | ◎ | ◎ | ○ | x | ○ |
| | 17 | 850 | 70 | 0.01 | " | 966 | ◎ | ◎ | ○ | ○ | ○ |

the change of the weight before and after the test. The unit of the corrosion rate was expressed by mm/y. When a corrosion rate of a material in a environment is less than 0.1 mm/y, the material is regarded generally sufficiently corrosion resistant and can be used in the environment.

The test results are altogether shown in Table 2. In the impact test results of Table 2, symbol ○ shows that the fracture appearance transition temperature was not more than −30° C., symbol x shows that the fracture appearance transition temperature was higher than −30° C. but not more than 0° C., and symbol xx shows that the fracture appearance transition temperature was more than 0° C. In the maximum hardness of the welding heat affected zone shown in Table 2, symbol O shows that the maximum hardness was less than 300, symbol x shows that the maximum hardness was 300 to less than 450 and xx shows that the maximum hardness was not less than 450. In the corrosion test results shown in Table 2, symbol ◎ shows that the corrosion rate was less than 0.05 mm/y, symbol ○ shows that the corrosion rate was 0.05 to less than 0.10 mm/y, symbol x shows that the corrosion rate was 0.1 to less than 0.5 mm/y and symbol xx shows that the corrosion rate was at least 0.5 mm/y.

As can be clearly seen from Table 2, the steels of Examples 1 to 12 of the present invention had a yield strength of 500 to 560N/mm$^2$ and this value was low as a value of this kind of steel. All these steels had a sufficient strength as a structure, had excellent impact toughness in both the base metal and in the welding heat affected zone and exhibited excellent corrosion resistance in a wet carbon dioxide environment. In other words, they had both excellent corrosion resistance and weldability. Therefore, steels having excellent characteristics could be produced at a low cost and with high productivity without heat-treatment such as quenching-tempering or normalizing-tempering.

In contrast, all of Comparative Examples could not provide sufficient characteristics. Because the composition was not suitable and because the cooling rate after hot rolling was too high in Comparative Example 13, the strength was extremely high and, the characteristics were inferior. Because the composition was not suitable in Comparative Example 14, the steel could not satisfy the strength necessary for the structure and, the impact toughness was inferior. Because the composition was not suitable in Comparative Example 15, the strength was too high, and since the weld cracking occurred, the impact test could not be carried out. Because the cooling rate after hot rolling was too large in Comparative Example 16, the strength was extremely high, and the impact toughness of the base metal was inferior. Because the Ni content was too high in Comparative Example 17, strength could not be lowered by cooling after hot rolling.

EXAMPLE 2

Steels having the chemical compositions tabulated in Table 3 were melted, and slabs having thickness of 240 mm were produced. Next, ordinary hot rolling was carried out under the condition tabulated in Table 4 to produce hot coils having a strip thickness of 11 mm. Further, electric resistance seam welded steel pipes having an outer diameter of 323.9 mm were produced on an electric resistance seam welded steel pipe line. The slab heating temperature before hot rolling was 1,230° C. Comparative Example 17 corresponded to an AISI420 steel. A tensile testpiece was sample from each steel pipe, and a tensile test was carried out to measure a yield strength.

TABLE 3

| | | Chemical Components (wt %) | | | | | | | | | | | | | |
|---|---|---|---|---|---|---|---|---|---|---|---|---|---|---|---|
| | | C | Si | Mn | P | S | Cr | Cu | Al | N | Ni | Co | Mo | W | others |
| Example of this Invention | 1 | 0.006 | 0.07 | 0.40 | 0.015 | 0.001 | 11.95 | 3.17 | 0.06 | 0.005 | — | — | — | — | |
| | 2 | 0.004 | 0.10 | 0.39 | 0.012 | 0.002 | 12.14 | 3.05 | 0.04 | 0.006 | — | — | — | — | |
| | 3 | 0.007 | 0.22 | 0.38 | 0.014 | 0.001 | 11.99 | 3.09 | 0.05 | 0.011 | 0.38 | — | — | — | |
| | 4 | 0.007 | 0.20 | 0.38 | 0.015 | 0.002 | 12.11 | 2.59 | 0.03 | 0.008 | — | — | 0.95 | — | |
| | 5 | 0.009 | 0.22 | 0.26 | 0.011 | 0.004 | 12.50 | 2.59 | 0.03 | 0.008 | 0.95 | — | — | — | Ti 0.32 |
| | 6 | 0.010 | 0.19 | 1.34 | 0.011 | 0.003 | 12.57 | 1.88 | 0.04 | 0.007 | — | — | 0.55 | 0.31 | |
| | 7 | 0.006 | 0.14 | 0.47 | 0.010 | 0.003 | 12.33 | 2.88 | 0.08 | 0.006 | — | — | — | — | Nb 0.37 |
| | 8 | 0.008 | 0.13 | 0.69 | 0.008 | 0.003 | 12.05 | 2.89 | 0.05 | 0.007 | — | 0.12 | — | — | Nb 0.32, Ti 0.18 |
| | 9 | 0.008 | 0.14 | 0.66 | 0.007 | 0.001 | 11.98 | 3.08 | 0.04 | 0.008 | — | — | 0.76 | — | Ti 0.36, Zr 0.13 |
| | 10 | 0.006 | 0.22 | 0.44 | 0.012 | 0.003 | 13.10 | 3.34 | 0.04 | 0.007 | 1.02 | — | — | — | Ti 0.29, V 0.34 |
| | 11 | 0.007 | 0.11 | 0.42 | 0.012 | 0.003 | 9.11 | 2.72 | 0.04 | 0.007 | — | — | — | 1.27 | |
| | 12 | 0.006 | 0.10 | 0.45 | 0.012 | 0.003 | 12.02 | 2.80 | 0.04 | 0.008 | — | 0.23 | 0.77 | — | Nb 0.24, Ti 0.14 |
| Comparative Example | 13 | 0.017 | 0.20 | 0.41 | 0.012 | 0.005 | 13.20 | 2.94 | 0.10 | 0.006 | 0.57 | — | — | — | |
| | 14 | 0.010 | 0.20 | 0.48 | 0.017 | 0.003 | 12.78 | — | 0.05 | 0.013 | — | — | — | — | |
| | 15 | 0.058 | 0.22 | 0.46 | 0.012 | 0.003 | 12.77 | — | 0.03 | 0.030 | — | — | — | — | |
| | 16 | 0.010 | 0.28 | 0.42 | 0.015 | 0.005 | 13.35 | 3.17 | 0.04 | 0.017 | 3.55 | — | 0.49 | — | Nb 0.15 |
| | 17 | 0.188 | 0.26 | 0.47 | 0.017 | 0.003 | 12.92 | — | 0.04 | 0.018 | 0.31 | — | — | — | |

TABLE 4

| | | Rolling Finish Temp. (°C.) | Cumulative Rolling Reduction Ratio Below 1,050° C. (%) | Cooling Rate to 500° C. (°C./sec) | Reheat Treatment Condition of Hot Coil (°C. × h) | Heat-Treatment Condition of Electric Resistance Seam Welded Portion (post-annealer) (°C.) | Heat-Treatment Condition of Electric Resistance Seam Welded Steel Pipe (°C. × h) | Yield Strength (N/mm²) | Corrosion Resistance 120 °C. | Corrosion Resistance 150 °C. | Max. Hardness of Welding Heat Affected Zone | Impact Toughness Base Metal | Impact Toughness Welding Heat Affected Zone | Weld Portion Tensile Test |
|---|---|---|---|---|---|---|---|---|---|---|---|---|---|---|
| Example of this Invention | 1 | 850 | 85 | 0.01 | nil | nil | nil | 555 | ◎ | ◎ | ○ | ○ | ○ | ○ |
| | 2 | 880 | 80 | 0.007 | 730 × 2.5 | " | " | 551 | ◎ | ◎ | ○ | ○ | ○ | ○ |
| | 3 | 900 | 85 | 0.01 | nil | " | 720 × 1 | 524 | ◎ | ◎ | ○ | ○ | ○ | ○ |
| | 4 | 880 | 80 | 0.01 | 700 × 2 | 680 | nil | 530 | ◎ | ◎ | ○ | ○ | ○ | ○ |
| | 5 | 920 | 77 | 0.01 | 720 × 0.5 | 720 | 720 × 1 | 531 | ◎ | ◎ | ○ | ○ | ○ | ○ |
| | 6 | 880 | 77 | 0.01 | nil | nil | 720 × 2 | 535 | ◎ | ◎ | ○ | ○ | ○ | ○ |
| | 7 | 880 | 77 | 0.007 | " | " | 750 × 1 | 518 | ◎ | ◎ | ○ | ○ | ○ | ○ |
| | 8 | 900 | 80 | 0.01 | 710 × 1 | " | 680 × 0.5 | 531 | ◎ | ◎ | ○ | ○ | ○ | ○ |
| | 9 | 850 | 80 | 0.005 | 710 × 2 | 730 | nil | 533 | ◎ | ◎ | ○ | ○ | ○ | ○ |
| | 10 | 900 | 85 | 0.01 | nil | 720 | 690 × 2 | 536 | ◎ | ◎ | ○ | ○ | ○ | ○ |
| | 11 | 900 | 77 | 0.01 | 680 × 4 | 720 | nil | 540 | ◎ | ○ | ○ | ○ | ○ | ○ |
| | 12 | 910 | 77 | 0.01 | nil | 700 | 740 × 1 | 526 | ◎ | ◎ | ○ | ○ | ○ | ○ |
| Comparative Example | 13 | 850 | 70 | 0.4 | nil | nil | nil | 972 | ◎ | ○ | ○ | x | ○ | x |
| | 14 | 880 | 70 | 0.004 | " | " | " | 299 | ○ | ○ | ○ | xx | xx | ○ |
| | 15 | 860 | 70 | 0.02 | " | " | " | 624 | ○ | x | x | x | xx | Δ |
| | 16 | 880 | 75 | 0.01 | " | " | " | 1013 | ◎ | ◎ | ○ | ○ | ○ | x |
| | 17 | 850 | 70 | 0.01 | " | " | " | 794 | xx | xx | weld cracking | xx | weld cracking | weld cracking |

Next, these steel pipes were welded to form weld joints by manual arc welding as welding corresponding to on-site circumferential welding at the time of laying-down of a line pipe. Welding heat input was 17 kJ/cm, and the welding material was a 24.8%Cr-8.1%Ni-1.8%Mo-0.017%C duplex stainless steel type welding rod. This welding rod provided a very high joint tensile strength as a stainless steel. JIS No. 4 impact testpieces (full size) were sampled from the base metal and from the heated affected zone of each weld portion, and the impact test was carried out. The maximum hardness of the welding heat affected zone was measured as a Vickers hardness at a load of 1 kg. A testpiece was sampled from the base metal of each steel pipe, and the corrosion test was carried out in the wet carbon dioxide environment. The corrosion test in the wet carbon dioxide environment was carried out in the same way and under the same condition as in Example 1. Tensile testpieces were sampled in the longitudinal direction of the steel pipes in such a manner as to include the weld metal, the welding heat affected zone and the base metal, and the tensile test of the weld portion was carried out.

The test results are tabulated in Table 4. In the corrosion rest results, the maximum hardness of the welding heat affected zone and the impact test results shown in Table 4, symbols have the same meaning as in Example 1. Symbol ○ in the tensile test result of the weld portion in Table 4 shows that fracture occurred in the base metal, symbol x shows that fracture occurred in the weld metal and symbol Δ shows that fracture occurred in the base metal while the weld metal underwent large deformation.

As can be clearly seen from Table 4, Examples 1 to 12 of the present invention provided a yield strength of 500 to 560N/mm$^2$ corresponding to the strength of API X-65 to X-70 classes, and these values are necessary and sufficient values for the line pipes and pipings. All of these Examples were excellent in the impact toughness of the base metal and the welding heat affected zone, had a low maximum hardness at the welding heat affected zone and exhibited excellent corrosion resistance in the wet carbon dioxide environment. It could be understood that these Examples had excellent corrosion resistance and weldability. When Examples 1 to 12 of the present invention were used, the fracture position in the tensile test of the weld portion existed at the base metal in all these Examples, and the sound weld portions could be obtained. This satisfied the industrial requirement that the weld metal had higher strength than the base metal.

In other words, the steel pipes having excellent characteristics could be produced at a low cost and with high productivity without applying heat-treatment such as quenching-tempering or normalizing-tempering to the steel pipes.

In contrast, all of Comparative Examples failed to provide sufficient characteristics. Because the cooling rate after hot rolling was too high in Comparative Example 13, the strength was extremely high and the characteristics were inferior. Because the composition was not suitable in Comparative Example 14, the strength necessary for the line pipe and the piping could not be obtained and, the impact toughness was low. Because the composition was not suitable in Comparative Example 15, the hardness of the welding heat affected zone was high and the impact toughness was low. Because the Ni content was too high in Comparative Example 16, the strength could not be lowered by cooling after hot rolling and consequently, fracture occurred at the weld metal in the tensile test of the weld portion. Because the composition was not suitable in Comparative Example 17, the strength was too high, the weld cracking occurred, and the impact test of the welding heat affected zone and the tensile test of the weld portion could not be carried out.

As described above, the present invention makes it possible to produce, at low cost and with high productivity, a steel and a steel pipe each having excellent corrosion resistance and weldability, and makes great contribution to the development of the industry.

We claim:

1. A production method for a steel material having excellent corrosion resistance and weldability comprising the steps of:

heating a steel slab containing, in terms of percent by weight:

Si: 0.01 to 0.6%,

Mn: 0.02 to 1.8%,

Cr: 7.5 to 14.0%,

Cu: 1.5 to 4.0%,

Al: 0.005 to 0.10%, and reducing

C: to not more than 0.02%,

N: to not more than 0.02%,

P: to not more than 0.025%,

S: to not more than 0.01%, and the balance consisting of Fe and unavoidable impurities, to a temperature within the range of 1,100° to 1,300° C.;

finishing hot rolling having a cumulative rolling reduction quantity at a temperature not more than 1,050° C. of at least 65% and at a rolling finish temperature of not less than 800° C.;

carrying out cooling at a cooling rate of less than 0.02° C./sec to at least 500° C.; and obtaining a steel material the metallic structure of which substantially consists of ferrite.

2. A production method for a steel material having excellent corrosion resistance and weldability according to claim 1, wherein the slab further contains, as additional elements and in terms of percent by weight, at least one of the following elements:

Ni: not more than 1.5%,

Co: not more than 1.0%,

Mo: not more than 3.0%, and

W: not more than 3.0%, and wherein the sum of Ni+Co is not more than 1.5% and the sum of Mo+W is not more than 3.0%.

3. A production method for a steel material having excellent corrosion resistance and weldability according to claim 1, wherein the slab further contains, as the additional elements, not more than 1.0% in total of at least one of the following elements:

Nb, V, Ti, Zr and Ta.

4. A production method for a steel material having excellent corrosion resistance and weldability according to claim 1, wherein the C and N contents of the slab are reduced as follows, in terms of percent by weight:

C: not more than 0.015%, and

N: not more than 0.015%, and wherein the sum of C and N is not more than 0.02%.

5. A production method for a steel material having excellent corrosion resistance and weldability according to claim 1, wherein the MC value of the slab chemical compositions given by the following formula is at least 0:

$$\text{MC value} = 80 + 420[\%C] + 440[\%N] + 30([\%Ni] + [\%Cu] + [\%Co] + 15[\%Mn] - 12([\%Si] + [\%Cr] + [\%Mo]) - 24[\%Nb] - 48([\%V]) + [\%Ti] + [\%Al]) - 6[\%W]$$

where [%X] represents the content of an element X expressed by percent by weight.

6. A production method for a steel pipe having excellent corrosion resistance and weldability, comprising serially making a steel pipe through the following steps ① and ② from a steel slab which contains, in terms of percent by weight, the following elements:

Si: 0.01 to 0.6%,

Mn: 0.02 to 1.8%,

Cr: 7.5 to 14.0%,

Cu: 1.5 to 4.0%, and

Al: 0.005 to 0.10%, which reduces the following elements:

C: to not more than 0.02%,

N: to not more than 0.02%,

P: to not more than 0.025%, and

S: to not more than 0.01%, and the balance of which consists of Fe and unavoidable impurities:

① heating the slab to a temperature within the range of 1,100° to 1,300° C., finishing hot rolling within a temperature range where the metallic structure substantially comprises an austenite monophase, and also finishing hot rolling where a cumulative rolling reduction quantity at a temperature not more than 1,050° C. is at least 65%, to thereby form a hot coil having a strip thickness of 3.0 to 25.4 mm, coiling said hot coil within a temperature range where the metallic structure substantially comprises the austenite monophase, and carrying out cooling at a cooling rate of less than 0.02° C./sec. to at least 500° C., and forming a steel strip the metallic structure of which substantially comprises ferrite; and ② slitting said hot coil into a selected width, continuously shaping it into a cylindrical shape and welding both ends of the steel strip by electric resistance welding to thereby form an electric resistance seam welded pipe.

7. A production method for a steel pipe having excellent corrosion resistance and weldability according to claim 6, wherein the slab further contains, as additional elements and in terms of percent by weight, at least one of the following elements:

Ni: not more than 1.5%,

Co: not more than 1.0%,

Mo: not more than.3.0%, and

W: not more than 3.0%, and wherein the sum of Ni+Co is not more than 1.5% and the sum of Mo+W is not more than 3.0%.

8. A production method for a steel pipe having excellent corrosion resistance and weldability according to claim 7, wherein the slab further contains, as additional elements and in terms of percent by weight, not more than 1.0% in total of at least one of the following elements:

Nb, V, Ti, Zr and Ta.

9. A production method for a steel pipe having excellent corrosion resistance and weldability according to claim 6, wherein the C and N contents of the slab is reduced, in terms of percent by weight:

C: not more than 0.015%, and

N: not more than 0.015%, and wherein the sum of C and N is reduced to not more than 0.02%.

10. A production method for a steel pipe having excellent corrosion resistance and weldability according to claim 6, wherein the MC value of the slab chemical compositions given by the following formula is at least 0:

$$\text{MC value} = 80 + 420[\%C] + 440[\%N] + 30([\%Ni] + [\%Cu] + [\%Co] + 15[\%Mn] - 12([\%Si] + [\%Cr] + [\%Mo]) - 24[\%Nb] - 48([\%V]) + [\%Ti] + [\%Al]) - 6[\%W]$$

where [%X] represents the content of an element X expressed by percent by weight.

11. A production method for a steel pipe having excellent corrosion resistance and weldability according to claim 6, wherein pipe making is conducted by electric resistance seam welding, and after the temperature of the electric resistance seam welded portion drops to a temperature not more than an Ms point, and at least the electric resistance seam welded portion and portions within 2 mm from both sides of said seam welded portion are reheated to a temperature of 650° C. to an $A_{c1}$ transformation point, and are then cooled.

12. A production method for a steel pipe having excellent corrosion resistance and weldability according to claim 6, wherein pipe making is conducted by electric resistance seam welding, at least the electric resistance seam welded portion and portions within 2 mm from both sides of said seam welded portion are reheated to a temperature not less than (an $A_{c3}$ transformation point +50° C.), are then rapidly cooled to a temperature not more than an Ms point, and furthermore, at least said electric resistance seam welded portion and the portions within 2 mm from both sides of said seam welded portion are reheated to a temperature of 650° C. to an $A_{c1}$ transformation point, and are then cooled.

13. A production method for a steel pipe having excellent corrosion resistance and weldability according to claim 11, wherein, when at least said electric resistance seam welded portion and the portions within 2 mm from both sides of said seam welded portion are reheated to 650° C. to the $A_{c1}$ transformation point and are then cooled, the full-body of the steel pipe is reheated.

14. A production method for a steel pipe having excellent corrosion resistance and weldability according to claim 11, wherein, when at least said electric resistance seam welded portion and the portions within 2 mm from both sides of said seam welded portion are reheated to 650° C. to the $A_{c1}$ transformation point and are then cooled, only the portion in the vicinity of said electric resistance seam welded portion is reheated by a post-annealer.

15. A production method for a steel material having excellent corrosion resistance and weldability according to claim 1 further comprising:

after finish hot rolling, cooling the steel to a temperature of not more than 500° C.;

then reheating said cooled steel to a temperature of not less than 650° C., said reheating satisfying the following condition:

$$T\times(\log t+21)\geqq 21{,}000$$

wherein T is reheating temperature (K), and t is reheating holding time (min).

16. A production method for a steel pipe having excellent corrosion resistance and weldability according to claim 6 further comprising:

cooling said hot coil to a temperature of not more than 500° C.;

then reheating said cooled coil to a temperature of not less than 650° C., said reheating satisfying the following condition:

$$T\times(\log t+21)\geqq 21{,}000$$

wherein T is reheating temperature (K), and t is reheating holding time (min).

* * * * *